US007282860B2

(12) United States Patent
Shibata et al.

(10) Patent No.: US 7,282,860 B2
(45) Date of Patent: Oct. 16, 2007

(54) PLASMA DISPLAY PANEL WITH A DIELECTRIC LAYER HAVING DEPRESSIONS BETWEEN PROJECTIONS AND FORMING VENTILATION PATHS

(75) Inventors: Masayuki Shibata, Kawasaki (JP); Hideki Harada, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 11/489,562

(22) Filed: Jul. 20, 2006

(65) Prior Publication Data

US 2006/0255731 A1 Nov. 16, 2006

Related U.S. Application Data

(63) Continuation of application No. 10/361,627, filed on Feb. 11, 2003, now Pat. No. 7,102,286.

(30) Foreign Application Priority Data

Apr. 18, 2002 (JP) ..... 2002-116038

(51) Int. Cl.
*H01J 17/49* (2006.01)

(52) U.S. Cl. ..... 313/582; 313/586

(58) Field of Classification Search ..... 313/582–587
See application file for complete search history.

(56) References Cited

U.S. PATENT DOCUMENTS

| | | | |
|---|---|---|---|
| 5,825,128 | A | 10/1998 | Betsui et al. |
| 6,160,345 | A | 12/2000 | Tanaka et al. |
| 6,326,727 | B1 | 12/2001 | Chung |
| 6,450,849 | B1 | 9/2002 | Harada |
| 6,566,812 | B1 | 5/2003 | Torisaki et al. |
| 6,611,099 | B1 | 8/2003 | Murata et al. |
| 6,628,076 | B2 | 9/2003 | Amatsuchi |
| 2002/0021090 | A1 | 2/2002 | Sano et al. |
| 2003/0038599 | A1 | 2/2003 | Aoki et al. |
| 2003/0155862 | A1 | 8/2003 | Shirozu |

FOREIGN PATENT DOCUMENTS

| | | |
|---|---|---|
| EP | 1195790 | 4/2002 |
| JP | 06-044907 | 2/1994 |
| JP | 09-050768 | 2/1997 |
| JP | 2000-21304 | 1/2000 |
| JP | 2001-126628 | 5/2001 |
| JP | 2001-216903 | 8/2001 |
| WO | 02/25683 A1 | 3/2002 |
| WO | 02/084692 A2 | 10/2002 |

OTHER PUBLICATIONS

European Search Report dated Jun. 14, 2005.
Japanese Office Communication in JP Application No. 2002-116038 dated Feb. 20, 2007.

*Primary Examiner*—Vip Patel
(74) *Attorney, Agent, or Firm*—Staas & Halsey LLP

(57) ABSTRACT

A plasma display panel having a structure that enables high definition progressive display and has good productivity is provided. A dielectric layer that covers display electrodes is made a layer whose surface has projections and depressions along undulations of the surface on which the dielectric layer is formed. A partition is arranged so as to face the projections of the surface of the dielectric layer for ensuring a ventilation path for exhausting air.

8 Claims, 7 Drawing Sheets

PLASMA DISPLAY PANEL WITH A DIELECTRIC LAYER HAVING DEPRESSIONS BETWEEN PROJECTIONS AND FORMING VENTILATION PATHS

CROSS-REFERENCE TO RELATED APPLICATIONS

This application is a continuation of U.S. patent application Ser. No. 10/361,627, filed Feb. 11, 2003 now U.S. Pat. No. 7,102,286 which claims the benefit of Japanese Patent Application No. 2002-116038 filed on Apr. 18, 2002, in the Japanese Patent Office, the disclosure of which is incorporated herein by reference.

BACKGROUND OF THE INVENTION

1. Field of the Invention

The present invention relates to a plasma display panel (PDP) having a dielectric layer that covers display electrodes and a partition that divides a discharge space.

It is desired that a PDP has a panel structure suitable for a display with high luminance and high resolution.

2. Description of the Related Art

A surface discharge type is adopted for an AC type PDP for a color display. According to this surface discharge type, in display discharge for securing luminance, display electrodes to be anodes and cathodes are arranged in parallel on a front or a back substrate, and address electrodes are arranged so as to cross pairs of display electrodes. The surface discharge type PDP needs a partition for localizing discharge in the longitudinal direction of a display electrode (i.e., the row direction). As a simplest partition pattern that has a good productivity, a so-called stripe pattern is known well, in which band-like partitions that are linear in a plan view are arranged at boundaries between columns of a matrix display.

There is an arrangement form of the display electrodes in the surface discharge type, in which the number of rows N plus one of display electrodes are arranged substantially at a constant pitch. In this form, neighboring display electrodes make an electrode pair for surface discharge, and each of the display electrodes except both ends of the arrangement works for an odd row and an even row in a display. This form has an advantage in high definition (reduction of a row pitch) and in effective usage of a display screen.

In the conventional PDP that has display electrodes arranged at a pitch equal to the pitch of the partitions of the stripe pattern, an odd row display and an even row display share one display electrode. Accordingly, a display form is limited to an interlace form. In the interlace form, a half of the total number of rows in a whole screen are not used for a display in each of odd and even fields in such a way that even rows are not lighted in an odd field. Therefore, luminance in the interlace form is lower than that in the progressive form. In addition, since the interlace form causes flickers in a display of a still picture, it is difficult to satisfy the request of a display quality that is necessary for a high quality image device such as a DVD or a full-spec HDTV.

A display of the progressive form can be achieved by adopting a partition having a mesh pattern that divides a discharge space into cells. However, a PDP having a mesh pattern partition has a low productivity of filling a gas in the manufacturing process. Since an inner resistance to ventilation is large, vacuum exhaustion process needs a long time.

In order to reduce the resistance to ventilation, there is a method of cutting off the partition in part. Alternatively, the structure disclosed in Japanese unexamined patent publication No. 2001-216903, in which the dielectric layer is raised in part, has a sufficient ventilation path. However, the method of cutting off the partition or raising the dielectric layer in part causes increase of manufacturing steps and a cost of the product.

SUMMARY OF THE INVENTION

An object of the present invention is to provide a PDP having a structure suitable for a progressive display with high definition and a good productivity.

According to one aspect of the present invention, a dielectric layer that covers display electrodes is made a layer whose surface has projections and depressions along undulations of the surface on which the dielectric layer is formed, and a partition is disposed so as to face the projections of the surface of the dielectric layer. The surface layer of the dielectric layer has a step corresponding to the thickness of the display electrode, and a gap corresponding to the step size is formed as a ventilation path between the partition and the dielectric layer. The ventilation path enables exhausting process in manufacturing a PDP to be efficient. Even if the partition has a mesh pattern, the ventilation path enables the exhausting process to be performed quickly. This means that the cell structure is suitable for stabilizing discharge characteristics by cleaning the inside sufficiently. As a method for forming the dielectric layer, a plasma chemical vapor deposition process is suitable. Since the layer that is formed by this process covers groundwork in an isotropic manner, a special process for forming a ventilation path is not required.

DETAILED DESCRIPTION OF THE PREFERRED EMBODIMENTS

Hereinafter, the present invention will be explained more in detail with reference to embodiments and drawings.

Figure 1:
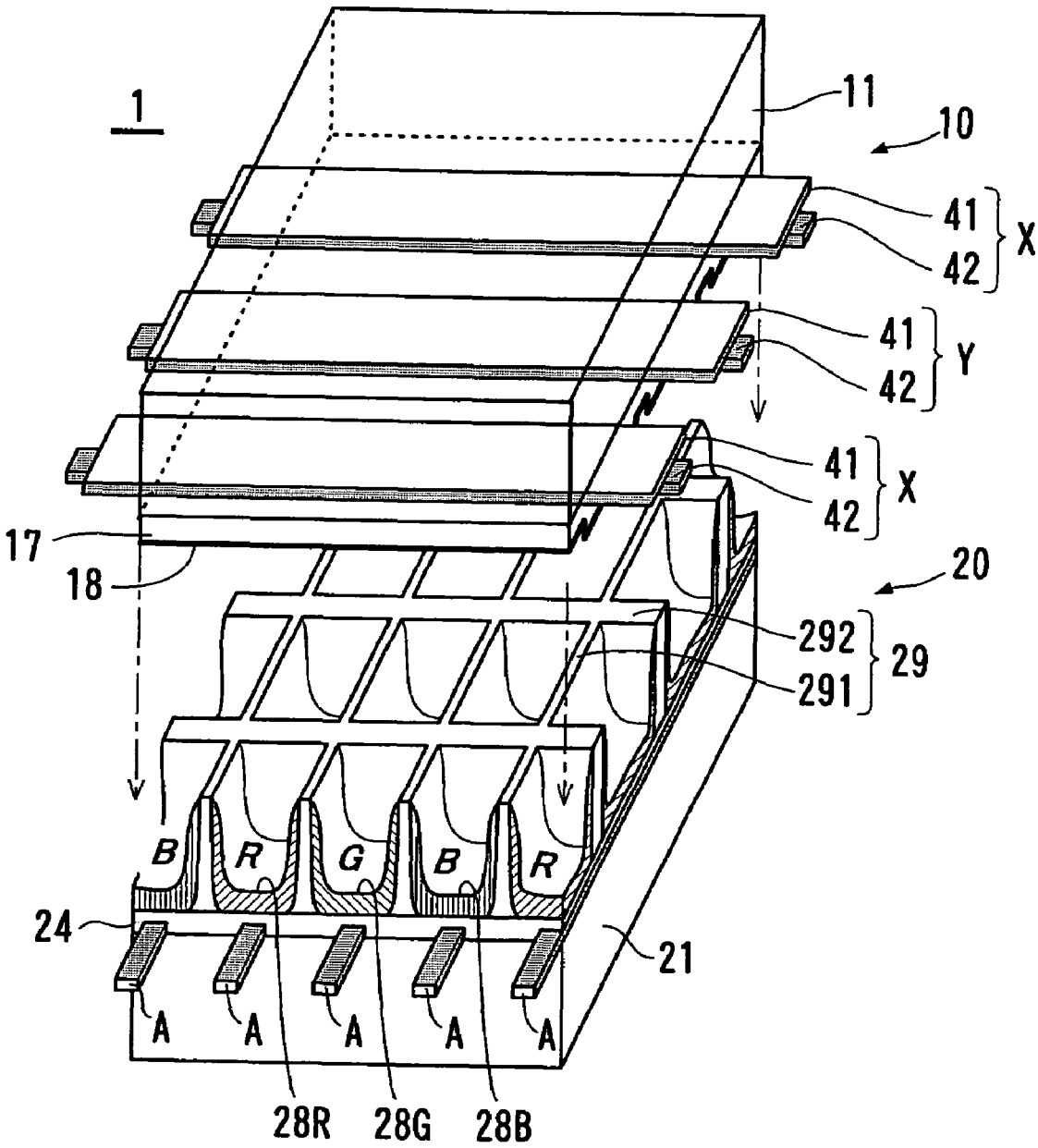
FIG. 1 is a diagram showing a cell structure of a PDP according to a first embodiment.
Figure 2:
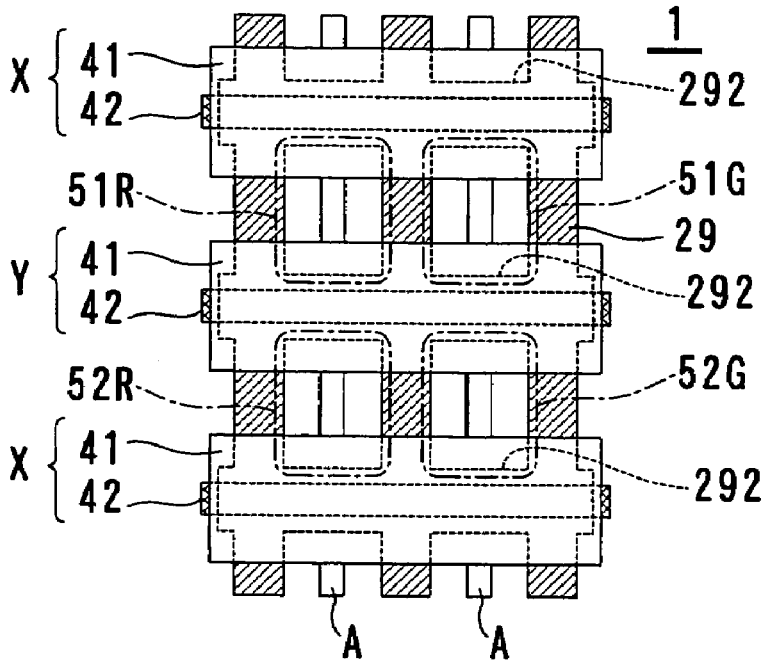
FIG. 2 is a diagram showing an electrode structure of the PDP according to the first embodiment.

FIG. 1 shows a cell structure of a PDP according to a first embodiment, and FIG. 2 shows an electrode structure of the PDP according to the first embodiment. The PDP 1 comprises a pair of substrate structural bodies (a structure of a substrate on which cell elements are disposed) 10 and 20. Display electrodes X and Y are arranged at a pitch equal to a row pitch on the inner surface of a glass substrate 11 that is a base of the front substrate structural body 10. The row means a set of cells having the same order in the column direction. Each of the display electrodes X and Y is made of a linear band-like transparent conductive film 41 for forming a surface discharge gap and a metal film (a bus conductor) 42 that is overlaid on the transparent conductive film 41 at the middle in the column direction. The metal film 42 is drawn out to the outside of the display screen so as to be connected to a driver circuit. The display electrodes X and Y are covered with a dielectric layer 17, which is coated with a protection film 18 made of a magnesia (MgO). Address electrodes A are arranged on the inner surface of a glass substrate 21 that is a base of the back substrate structural body 20 so that one address electrode corresponds to one column, and the address electrodes A are covered with a dielectric layer 24. On the dielectric layer 24, a mesh pattern partition 29 having the height of approximately 150 microns is arranged. The partition 29 has a grid pattern in a plan view comprising a first portion dividing a discharge space into columns (hereinafter referred to as vertical walls) 291 and a second portion dividing the discharge space into rows (hereinafter referred to as horizontal walls) 292. In addition, fluorescent material layers 28R, 28G and 28B of red, green and blue colors for a color display are arranged so as to cover the surface of the dielectric layer 24 and side faces of the partition 29. Italic letters (R, G and B) in FIG. 1 indicate light emission colors of the fluorescent materials. The color arrangement has a repeating pattern of red, green and blue colors in which cells in a column have the same color. The fluorescent material layers 28R, 28G and 28B emit light when being excited by ultraviolet rays emitted by the discharge gas. As shown in FIG. 2, the metal film 42 is arranged so as to overlap the horizontal wall 292 of the partition 29, and the transparent conductive film 41 protrudes at both sides of the horizontal wall 292 so as to form a surface discharge gap for each cell in cooperation with the neighboring transparent conductive film 41. In FIG. 2, four cells 51R, 51G, 52R and 52G are shown by dot-dashed lines as representatives. Since the partition pattern is a mesh or grid pattern, which is different from a stripe pattern in which horizontal walls are omitted, discharge interference does not occur in the column direction. Namely, in the PDP 1, a progressive display can be realized without a complicated driving sequence. In addition, the fluorescent material is provided also at the side faces of the horizontal wall 292, so that the light emission efficiency is improved. By arranging the metal films 42 of the display electrodes X and Y so as to overlap the horizontal wall 292, light shielding of display light by the metal film 42 can be eliminated. As a result, 10-20% improvement can be recognized.

Figure 3:
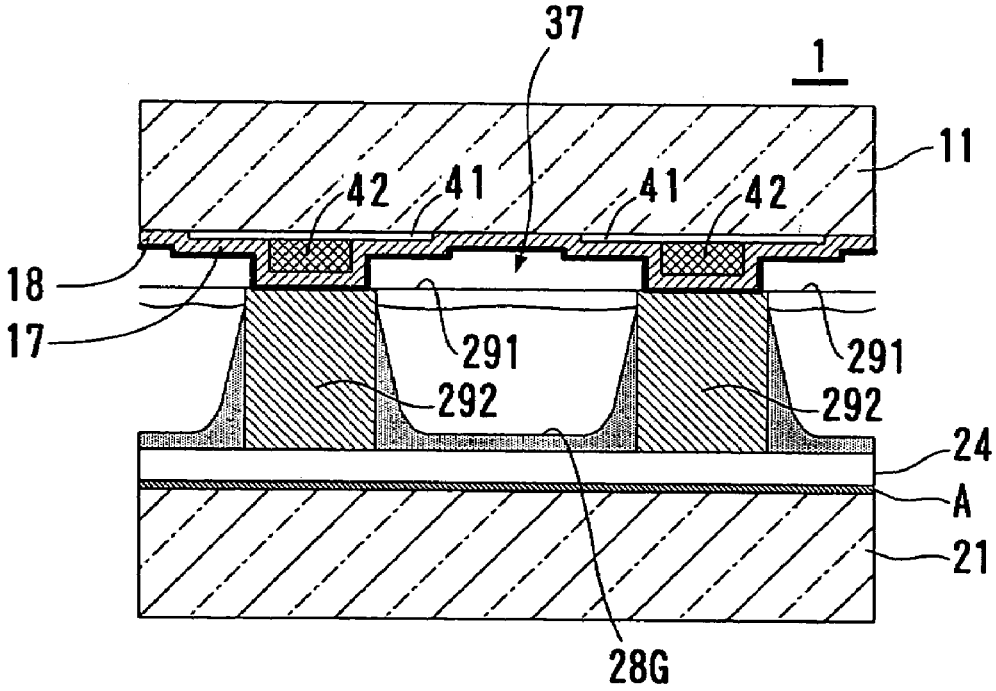
FIG. 3 is a cross section showing an inner structure of the PDP according to the first embodiment.

FIG. 3 is a cross section showing an inner structure of the PDP according to the first embodiment. In the PDP 1, the transparent conductive film 41 is made of ITO, whose thickness is 0.1 microns. The metal film 42 is made of three layers including chromium (Cr), copper (Cu) and chromium, and its thickness is set to a value within the range of 2-4 microns. The dielectric layer 17 is made of silicon dioxide ($SiO_2$) and is formed at a constant thickness by the plasma CVD process. The thickness of the dielectric layer 17 is preferably a value within the range of 5-10 microns. As shown in FIG. 3, the dielectric layer 17 has surface in which the projections and depressions of the forming surface (a part of the substrate surface and the surface of the display electrode) are reproduced faithfully. This is a feature that cannot be obtained by a usual forming process in which a paste is applied before burning. Since the surface of the dielectric layer 17 has projections and depressions, a gap to be a ventilation path 37 is formed between neighboring display electrodes X and Y The ventilation path 37 crosses over the vertical wall 291 and is continuous over a plurality of cells arranged along the display electrode. The size of the ventilation path 37 in the direction of the thickness of the substrate is 2-4 microns, substantially the same as the thickness of the metal film 42 and is sufficiently larger than the roughness of the surface of the dielectric layer 17 (measured value is approximately one micron). Because of this ventilation path 37, the time necessary for exhaustion in producing the PDP 1 is similar to the conventional PDP having the stripe pattern partition. Supposing that the display electrodes X and Y are thick film electrodes (such as silver electrodes) having the thickness of 8-10 microns, the time for exhaustion can be shortened so that cost efficiency of the production can be improved.

Figure 4:
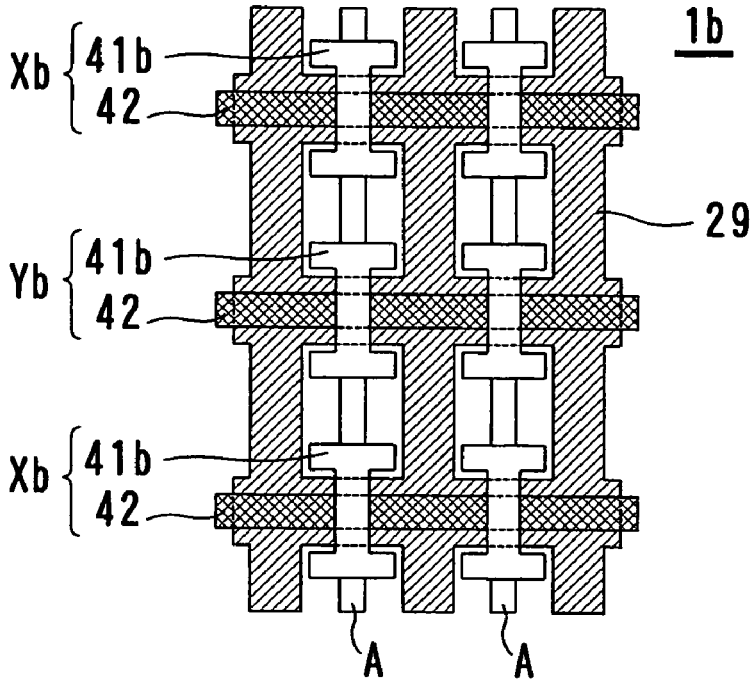
FIG. 4 is a plan view showing an electrode structure of a PDP according to a second embodiment.
Figure 5:
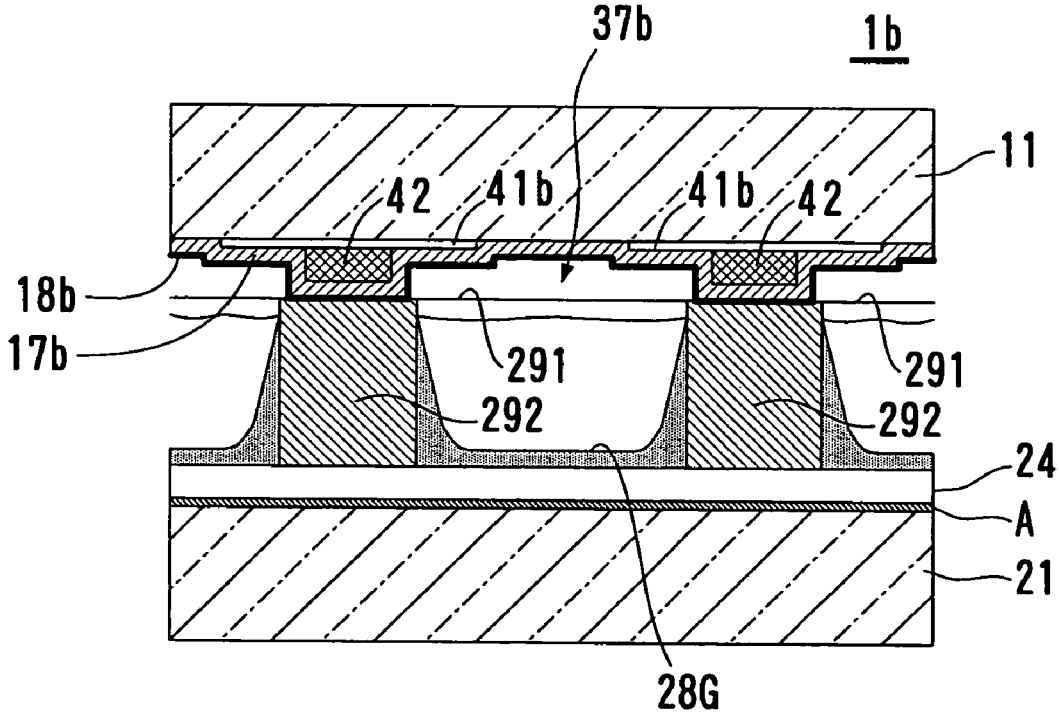
FIG. 5 is a cross section showing an inner structure of the PDP according to the second embodiment.

FIG. 4 is a plan view showing an electrode structure of a PDP according to a second embodiment. FIG. 5 is a cross section showing an inner structure of the PDP according to the second embodiment. Each of display electrodes Xb and Yb of the PDP 1*b* is made of an I-shaped transparent conductive film 41*b* arranged at each column and a linear band-like metal film 42. The display electrodes Xb and Yb are covered with a dielectric layer 17*b* and a protection film 18*b*. Since a gap to be a ventilation path 37*b* is formed between neighboring display electrodes Xb and Yb also in the PDP 1*b*, rapid exhaustion can be performed in its production. The transparent conductive film 41*b* is disposed so that the portion protruding from the metal film 42 is like a t-shape. Thus, discharge current is limited, so that light emission efficiency is improved, and capacitance between electrodes can be reduced.

Figure 6:
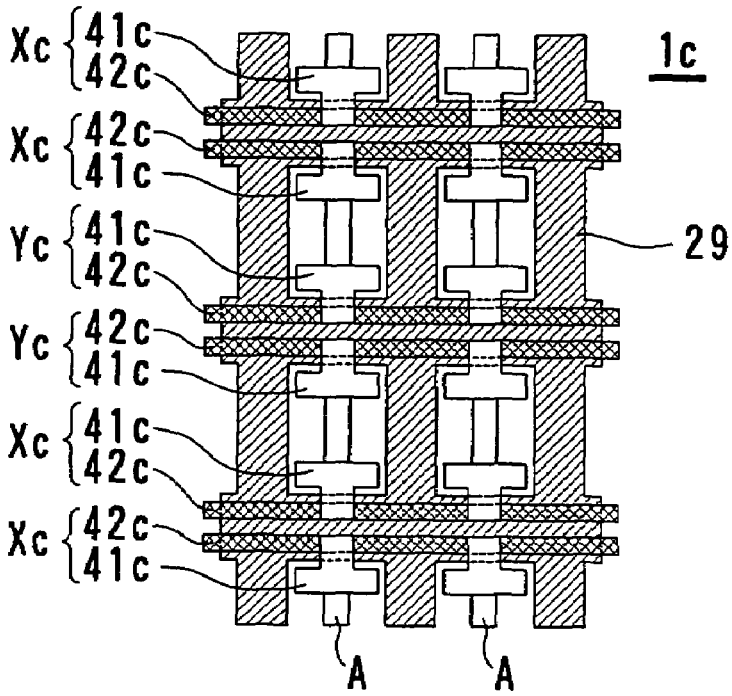
FIG. 6 is a plan view showing an electrode structure of a PDP according to a third embodiment.
Figure 7:
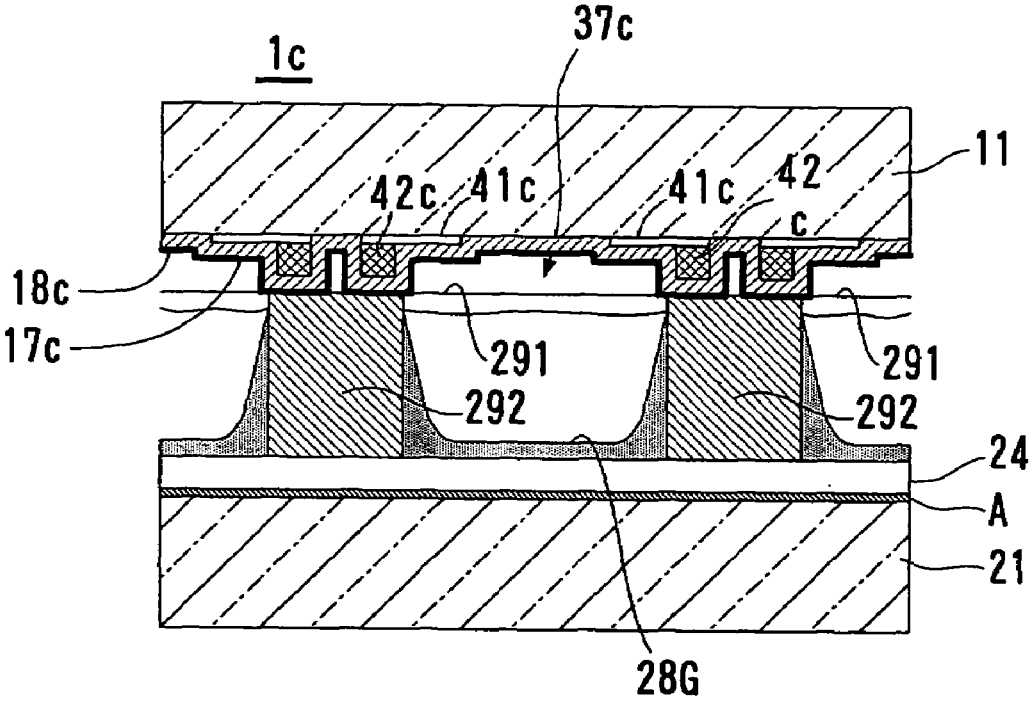
FIG. 7 is a cross section showing an inner structure of the PDP according to the third embodiment.

FIG. 6 is a plan view showing an electrode structure of a PDP according to a third embodiment. FIG. 7 is a cross section showing an inner structure of the PDP according to the third embodiment. Each of display electrodes Xc and Yc of the PDP 1*c* is made of a T-shaped transparent conductive film 41*c* arranged at each column and a linear band-like metal film 42*c*. The display electrodes Xc and Yc are covered with a dielectric layer 17*c* and a protection film 18*c*. Since a gap to be a ventilation path 37*c* is formed between neighboring display electrodes Xc and Yc also in the PDP 1*c*, rapid exhaustion can be performed in its production. Since the display electrodes Xc and Yc are independent for each row, a progressive display can be driven easily.

Figure 8:
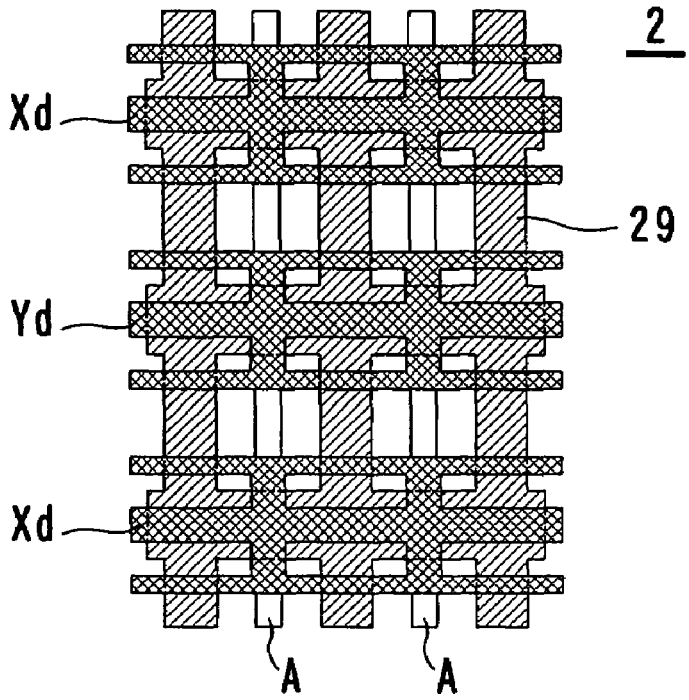
FIG. 8 is a plan view showing an electrode structure of a PDP according to a fourth embodiment.
Figure 9:
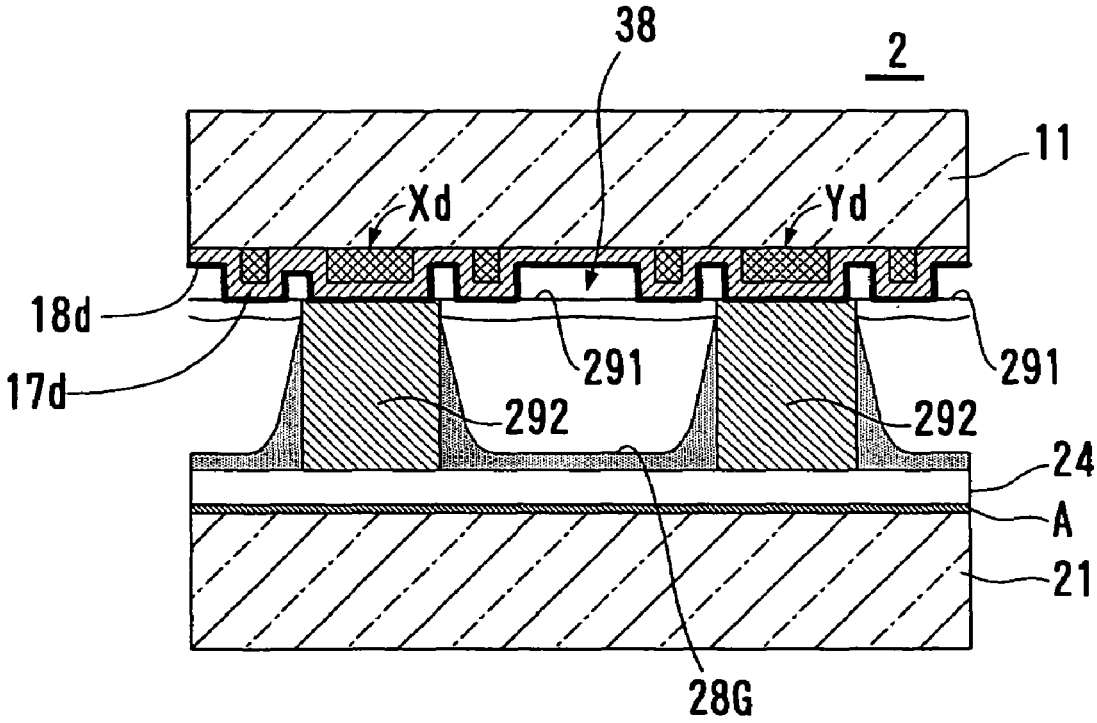
FIG. 9 is a cross section showing an inner structure of the PDP according to the fourth embodiment.

FIG. 8 is a plan view showing an electrode structure of a PDP according to a fourth embodiment. FIG. 9 is a cross section showing an inner structure of the PDP according to the fourth embodiment. Each of display electrodes Xd and Yd of the PDP 2 is made of a band-like metal film that is patterned in a shape having a gap that restricts discharge current. The display electrodes Xd and Yd are covered with a dielectric layer 17*d* and a protection film 18*d*. Since a gap to be a ventilation path 38 is formed between neighboring display electrodes Xd and Yd also in the PDP 2, rapid exhaustion can be performed in its production.

Figure 10:
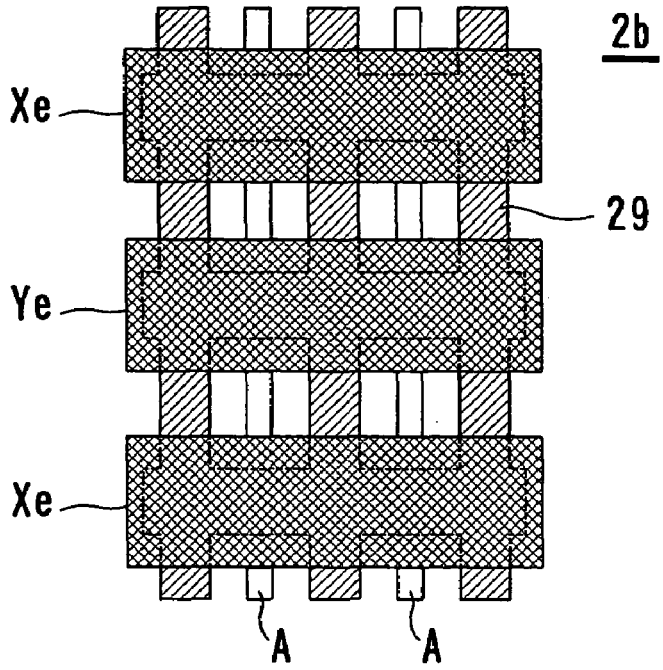
FIG. 10 is a plan view showing an electrode structure of a PDP according to a fifth embodiment.
Figure 11:
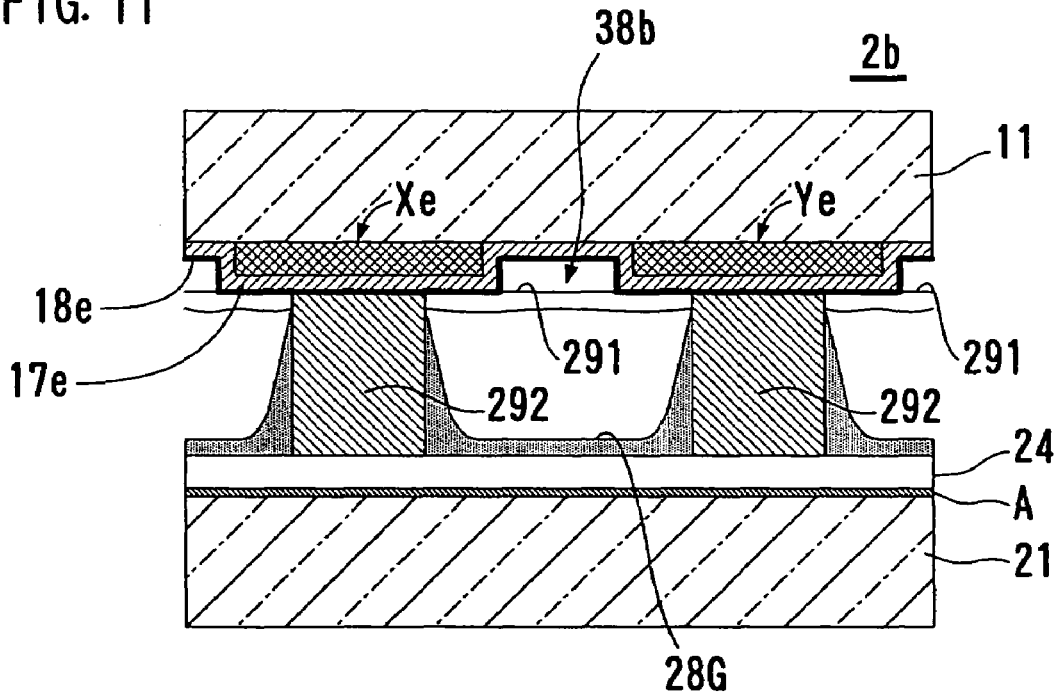
FIG. 11 is a cross section showing an inner structure of the PDP according to the fifth embodiment.

FIG. 10 is a plan view showing an electrode structure of a PDP according to a fifth embodiment. FIG. 11 is a cross section showing an inner structure of the PDP according to the fifth embodiment. Each of display electrodes Xe and Ye of the PDP 2*b* is made of a linear band-like metal film. The display electrodes Xe and Ye are covered with a dielectric layer 17*e* and a protection film 18*e*. Since a gap to be a ventilation path 38*b* is formed between neighboring display electrodes Xe and Ye also in the PDP 2*b*, rapid exhaustion can be performed in its production.

Figure 12:
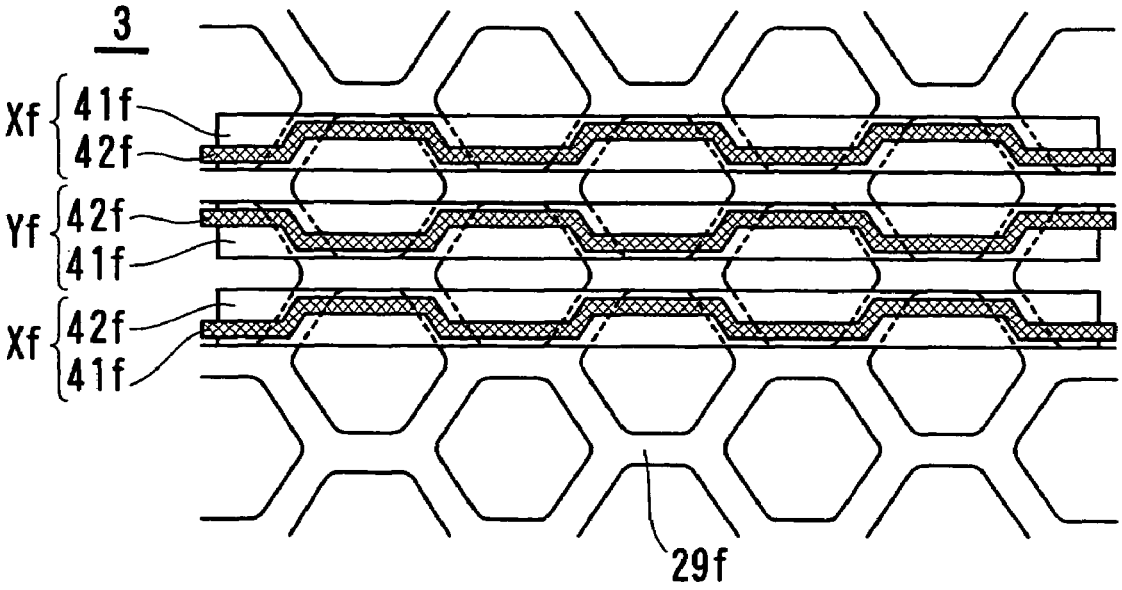
FIG. 12 is a plan view showing a partition pattern and display electrodes of a PDP according to a sixth embodiment.

FIG. 12 is a plan view showing a partition pattern and display electrodes of a PDP according to a sixth embodiment. The pattern of a partition 29*f* of the PDP 3 is a honeycomb pattern that is a type of the mesh pattern, and the shape of a cell is a hexagon. Each of display electrodes Xf and Yf is made of a linear band-like transparent conductive film 41*f* and a band-like metal film 42*f* that is meandering along the partition 29*f* so as to minimize light shield.

Figure 13:
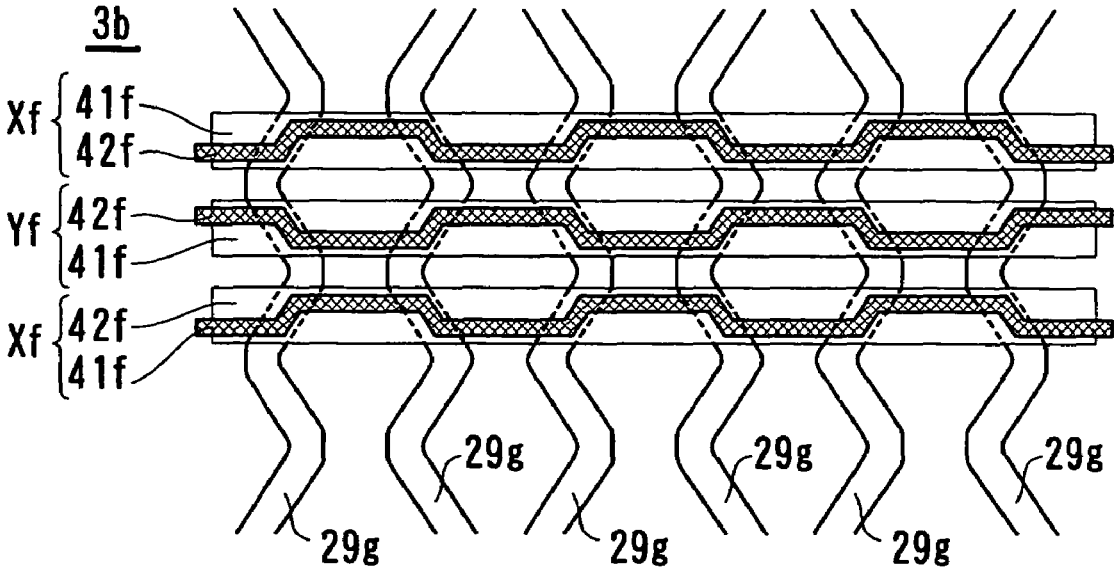
FIG. 13 is a plan view showing a partition pattern and display electrodes of a PDP according to a seventh embodiment.

FIG. 13 is a plan view showing a partition pattern and display electrodes of a PDP according to a seventh embodiment. The partition pattern of the PDP 3*b* is a stripe pattern made of a meandering band-like partition 29*g*. The partition 29*g* is arranged so as to form a column space in which wide portions and narrow portions are arranged alternately. Since the partition pattern of the PDP 3*b* is a stripe pattern, ventilation is free in the column direction crossing the display electrodes Xf and Yf. The ventilation path, which is formed by forming a dielectric layer similar to the above-mentioned embodiment, causes air flow in the direction along the display electrodes Xf and Yf, so that ventilation is performed rapidly.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A plasma display panel comprising:

a first substrate and a second substrate defining a discharge space therebetween;

a plurality of display electrodes arranged on an inner surface of the first substrate and extending in a first direction, each of the display electrodes comprising a metal film;

a first dielectric layer of a constant thickness and made of a silicon compound, deposited on said first substrate and covering display electrodes, the first dielectric layer having a surface with undulations therein, comprising projections corresponding to the underlying metal films as the display electrodes and depressions between the projections;

a partition formed on a second dielectric layer covering a plurality of address electrodes arranged on an inner surface of the second substrate, the partition having a grid shape in a plan view that divides the discharge space into a plurality of discharge cells spaced along the first direction; and plural ventilation gaps, each corresponding to a space between a depression and an opposed surface of the partition, aligned ventilation gaps, spaced in the first direction, forming a ventilation path along the first direction, wherein said thickness of the first dielectric layer is equal to or thinner than a thickness of the metal films of the display electrodes.

2. The plasma display panel according to claim 1, wherein a thickness of each metal film of display electrode is within a range of 8-10 microns, and a thickness of the first dielectric layer is within a range of 5-10 microns.

3. The plasma display panel according to claim 1 or 2, wherein the first dielectric layer of the silicon compound is formed by a plasma chemical vapor deposition process, and the second dielectric layer is formed by a burning process of a paste.

4. The plasma display panel according to claim 1 or 2, wherein the dielectric layer is made of a silicon dioxide deposition film having a constant thickness, and the metal film of the display electrode is made of a thick film of a silver.

5. A plasma display panel with a display cell arrangement comprising a plurality of projections on a surface of a dielectric layer converging metal film electrodes formed on a front substrate, said projections corresponding to said metal film electrodes where the dielectric layer is of substantially equal thickness and are in a contact with a grid shaped partition on a rear substrate, wherein said thickness of the dielectric layer is equal to or thinner than a thickness of the metal film electrodes, thereby providing a ventilation path between cells.

6. A plasma display panel according to claim 5, wherein said dielectric layer comprising a silicon dioxide film with a constant thickness in a range of 5 to 10 μm and protection film made of MgO formed on said silicon dioxide film, a surface of the protection film having projections and depressions corresponding to undulation of the metal film electrodes, wherein a top surface of the partition contact with the surface of said protection film at a portion corresponding to the projections.

7. A plasma display panel according to claim 5, wherein said grid shaped partition in a plan view divides a discharge space between the front and rear substrates into the cells, each of which is a polygon shape in the plan view.

8. A method of providing ventilation for a plasma display panel, comprising:

defining a discharge space between a first substrate and a second substrate;

arranging a plurality of display electrodes on an inner surface of the first substrate and to extend in a first direction, each of the display electrodes comprising a metal film;

depositing a first dielectric layer of a constant thickness on said first substrate and to cover display electrodes, the first dielectric layer having a surface with undulations therein, comprising projections corresponding to the underlying metal films as the display electrodes and depressions between the projections;

forming a partition on a second dielectric layer covering a plurality of address electrodes arranged on an inner surface of the second substrate, the partition having a grid shape in a plan view that divides the discharge space into a plurality of discharge cells spaced along the first direction; and forming a ventilation path with plural ventilation gaps, each corresponding to a space between a depression and an opposed surface of the partition, by aligning and spacing the ventilation gaps in the first direction, wherein said thickness of the first dielectric layer is equal to or thinner than a thickness of the metal films of the display electrodes.

* * * * *